United States Patent [19]

Van Der Meulen

[11] 4,437,373

[45] Mar. 20, 1984

[54] ARRANGEMENT FOR PERFORATING OR CUTTING FOILS

[76] Inventor: Leonard Van Der Meulen, 17, Rue M^dBayram V, Tunis el Menzah V, Tunisia

[21] Appl. No.: 401,327

[22] Filed: Jul. 23, 1982

[30] Foreign Application Priority Data

Jul. 30, 1981 [DE] Fed. Rep. of Germany ..... 3130090

[51] Int. Cl.³ ..... B26F 1/18

[52] U.S. Cl. ..... 83/346; 83/512; 83/659; 83/678; 83/695

[58] Field of Search ..... 83/695, 509, 510, 511, 83/512, 658, 659, 346, 347, 678

[56] References Cited

U.S. PATENT DOCUMENTS 3,138,985 6/1964 Mills ..... 83/510 X
3,456,540 7/1969 Manini ..... 83/512 X
3,765,286 10/1973 Vossen ..... 83/512 X
4,238,982 12/1980 Mock ..... 83/678 X

FOREIGN PATENT DOCUMENTS 2103139 2/1983 United Kingdom ..... 83/512

*Primary Examiner*—Donald R. Schran
*Attorney, Agent, or Firm*—Michael J. Striker

[57] ABSTRACT

An arrangement for perforating foils, particularly of synthetic plastic material, has an elongated cutter and a counterelement movable relative to one another in a direction of elongation of the cutter and also toward one another, wherein the cutter is provided over its entire length with an uninterrupted cutting edge, and the counterelement is composed of a plurality of rollers movable about their axes and located adjacent to one another, so as to provide for selective perforating or cutting.

21 Claims, 8 Drawing Figures

ARRANGEMENT FOR PERFORATING OR CUTTING FOILS

BACKGROUND OF THE INVENTION

The present invention relates to an arrangement for perforating or cutting foils, particularly composed of a synthetic plastic material, which has a cutter and a countersupport.

Cutting or perforating of foils, particularly composed of a synthetic plastic material formed as thermoplastic synthetic plastic foils, which must form bags, sacks and the like, is difficult in practice inasmuch as a plurality of requirements must be satisfied. For manufacturing bags, sacks, and the like flexible containers of thermoplastic synthetic plastic foil, the connection of two foil layers by heated welding bars or wires, perforation or cutting of the foil layers is performed with a high number of cycles. The foil working machines run as a rule in two layers, i.e. uninterruptedly in a very long time period. This means that the cutter and the countersupport must have very long service life. When the cutter or the countersupport is worn out and must be replaced by a new device, this causes, in addition to the required replacement work, a stoppage of the entire manufacturing machine.

Great emphasis must be put on the quality of the cut or the design of a perforation of many small cuts. Thus the cut must be effective and clean for many types of foils, taking into consideration their chemical composition or physical properties or their thickness. Foils with different such properties have also different conditions during cutting. Therefore there is a further requirement that the perforating or cutting arrangement can always be effective for different properties of the foils.

It is known from practice that a foil is perforated or cut better when maintained under tension. Since the foils must be repeatedlY welded immediately near a perforation seam, and cooling of the weld seam results in shrinking, the tension increases, which can lead to weakening of the weld seam. The desire to hold the foil for perforating or cutting under tension and at the same time to keep it loose for good welding connection has not been satisfied. Many foils to be worked are stretched in one direction, and also additionally stretched many times in a transverse direction. At the same time, there are so-called linear foils which are very thin and difficult to perforate and cut. On the other hand, on the grounds of cost economy, it is desirable to work very thin-walled foils. These, however, are very difficult to perforate or cut. Finally, there is a reciprocatable cutter with an immovable counterwelding support, and also a rotary cutter with a rotary countersupport.

In dependence upon the different properties, particular physical properties of the foil, and also in dependence upon the working steps following a perforation step, it is necessary in practice to retain during perforation webs of greater or lesser width between small cuts. For attaining the desired and exact dimensions, a perforation cutter is provided with appropriately dimensioned teeth which determines the length of the individual partial cuts. The teeth have at least rectangular shape. There are also triangular teeth with front tips. It is thereby possible, by selection of the insertion depth in the counterwelding support, for example of rubber, to determine the length of the cut. However, it has been recognized that this is very difficult to attain in practice.

U.S. Pat. No. 3,456,540 discloses an arrangement for perforating foils of thermoplastic synthetic plastic material, which has a cutter arranged under the foil to be cut and provided with teeth, wherein the cutter is raisable in direction to the foil to be cut with perforations via a cylinder-and-piston unit. Bars are arranged above the foil and extend in a direction of elongation of the perforation cutter. A plurality of levers arranged one behind the other are coupled with the bars and provided with a helical spring and small roll which is arranged at its front end facing toward the perforation cutter and cooperates with the latter. For perforating the foil, the bars move in the direction of elongation of the perforation cutter and simultaneously thereto, so that the rollers are supported on the cutter with interposition of the foil. Thereby only such perforation cuts can be produced the individual cuts of which correspond to the length of the teeth of the perforation cutter. Changes to this length of the perforation cut are not possible, and they can be made when required, only by replacing the perforation cutter by a new perforation cutter with differently dimensioned teeth. Since the rollers are spaced from one another by great distances which extend over the length of three teeth of the perforation cutter, the bars must reciprocate over a relatively great distance.

SUMMARY OF THE INVENTION

Accordingly, it is an object of the present invention to provide an arrangement for perforating foils, which avoids the disadvantages of the prior art.

More particularly, it is an object of the present invention to provide an arrangement for perforating foils in which perforation cuts of different cut length or a through cut of the foil can be attained without full replacement works.

In keeping with these objects, and with others which will become apparent hereinafter, one feature of the present invention resides, briefly stated, in an arrangement for perforating foils, particularly of synthetic plastic material, having an elongated cutter and a countersupport movable in a direction of elongation of the cutter relative to one another and in direction toward one another, wherein for selective perforating or cutting, the cutter has an uninterrupted cutting edge over its entire length and the countersupport is composed of a plurality of rollers which are spaced from one another by small distances or tightly abut against one another and are rotatable or rollable.

The inventive feature is that the selective perforation cuts of different lengths or a throughgoing cut can be manufactured by cooperation of an uninterrupted cutter in connection with a plurality of rollers.

In accordance with another feature of the present invention, the rollers have a small diameter, for example between 3 and 5 mm, and a great length which is equal to two to five times their diameter, so that the rollers can be identified as rolls or needles.

Yet another feature of the present invention is that the distance between the rollers corresponds to the distance between perforation cuts, as measured from center to center. The arrangement of the foil or several foils between the cutting edge of the cutter and the rollers, first on the upper apex of the rollers, or in other words in the point of the tangential support of the cutter on one roller with application of a pressure of the cutter on the rollers, results in a cut with a point-like shape.

In accordance with a further feature of the present invention, the cutter supported on the rollers performs a relative movement with respect to the rollers and thereby rotates the rollers, so that the point-shaped initial cut expands during further point-shaped abutment of the cutter on the roller to a linear cut. The length of the cut is dependent upon the amount of the relative movement of the cutter with respect to the roller or rollers. With a predetermined diameter of the rollers, an angle of turning of the individual rollers or the arc length L can be obtained. The arc length L is a distance over which the cutting edge of the cutter, in the event of point-like abutment of the upper surface of the roller, contacts the same during cutting. The arc length L corresponds to the length of cut of the perforations.

For applying a relative displacement between the cutter and the rollers, so as to obtain travelling of the point-like contact on the rollers over the arc length L, the cutter can be supported reciprocatable in its direction of elongation.

It is especially advantageous, in accordance with a further feature of the present invention, when the cutter is immovable in the longitudinal direction and the rollers of the countersupport are movable in a direction of elongation of the cutter. When the rollers move, the cutter successively abuts against the circumferential line of the arc length L. This feature has the advantage that no, or only insignificant, displacement of the foil takes place.

In accordance with still a further feature of the present invention, the metallic rollers are supported on an advantageously flexible strip of metal, particularly steel, which in turn is supported on a band of rubber or another elastic material. In this construction, the pressure applied from the cutter onto the rollers with interposition of the foil is adjustable, and particularly by the properties of the rubber band. Simultaneously, the pressure of the cutter onto the rollers can be determined by the amount of its compression.

An additional feature of the present invention is that the rubber band is carried by a carriage which travels in a longitudinal direction of the rubber band or the cutter in a reciprocating manner. The carriage can be formed as a sliding carriage. It is especially advantageous when it is composed of a plurality of rollers arranged rotatable at distances from one another in a supporting or carrying frame, which in turn is reciprocatable. The support for the countersupporting element can be reciprocatable as a whole, wherein it is especially advantageous when the support lies on the rollers of the carriage.

The displacement of the support or its reciprocation can be attained in different ways, for example by electromagnets which are easy to actuate in time sequences. It can also be performed by a pneumatic or hydraulic drive. It is especially advantageous when the support is reciprocatable against the action of a helical spring, and the displacement is advantageously performed by a cam.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
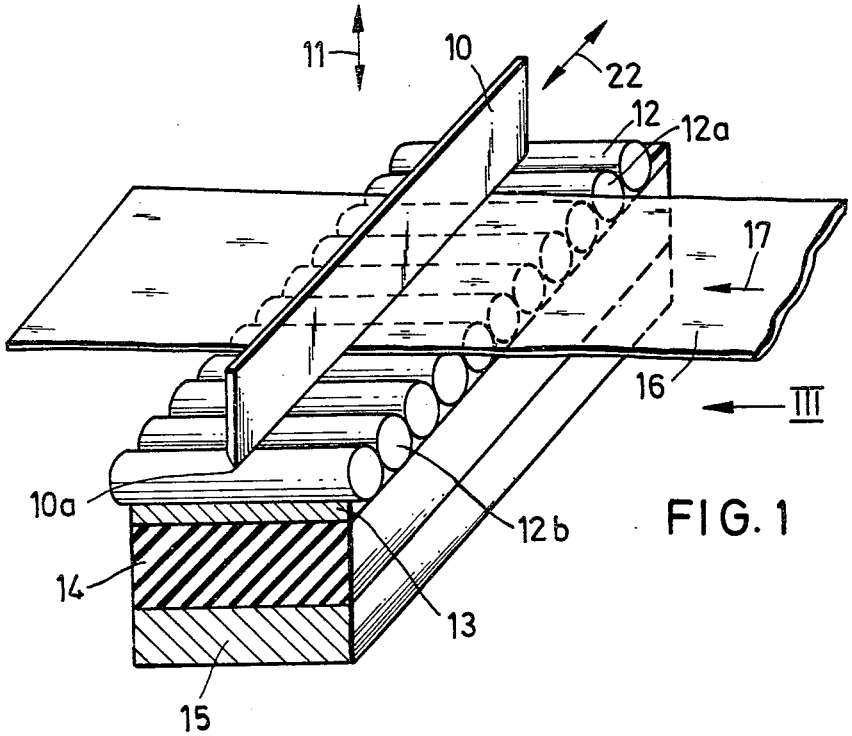
FIG. 1 is a perspective view showing an arrangement for perforating or cutting, in accordance with the present invention.

An arrangement for perforating and cutting in accordance with the present invention is shown in FIG. 1 and has a cutter 10 with a smooth and uninterrupted cutting edge, i.e. the cutting edge extending over a straight line and having no teeth. The cutter 10 reciprocates in a direction identified by the double arrow 11. The arrangement has a countercutting element composed of rollers 12, 12*a*, 12*b*, and so on, having a small diameter. The diameter of the rollers is equal to approximately 3 to 5 mm. The length of the rollers corresponds to a multiples of the diameter, for example two to five times the same. Thus, the rollers are formed as needles, since in their spatial form they correspond to the form of the needles used in needle bearings. The rollers are spaced from one another by a small distance or arranged in tight contact with one another and extend transverse to the direction of elongation of the cutter 10. The rollers are arranged so that they can rotate about their longitudinal axes. The distance between the adjacent circumferences of the rollers may be 0, 1 to 2 mm.

Figure 6:
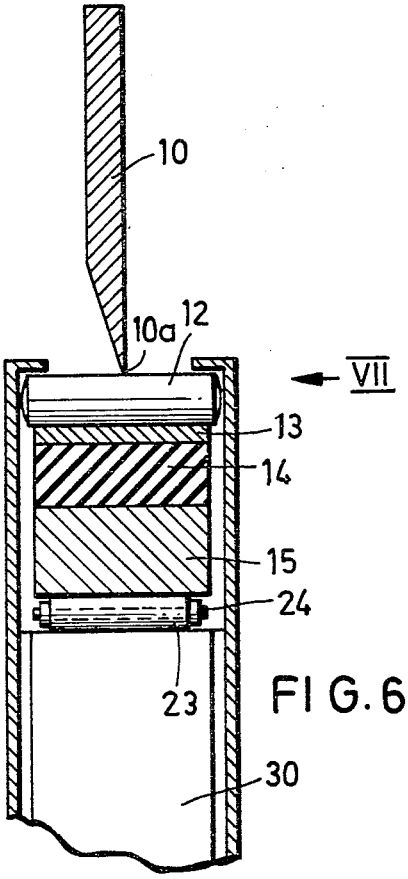
FIG. 6 is a view showing a perforating and cutting device of FIG. 4 on a larger scale.

The rollers are supported at their end side in a holder which is shown in FIG. 6. The rollers lie on a mainly flexible strip 13 composed, for example, of metal. The strip 13, in turn, lies on a band 14 of rubber or the like compressible material. The band of rubber is finally supported on a support 15 whose ends are mounted in a machine frame. A foil 16 is located between the cutter 10 and the rollers 12 and can be composed of one or several foil layers. The foil moves continuously or intermittently in a predetermined direction, identified by the arrow 17, and provided with perforations or a separating cut.

Figure 2:
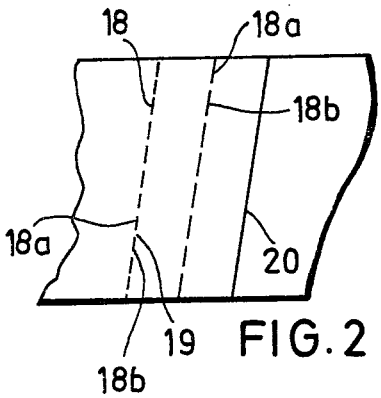
FIG. 2 is a perspective view of a foil worked in the inventive arrangement.
Figure 3:
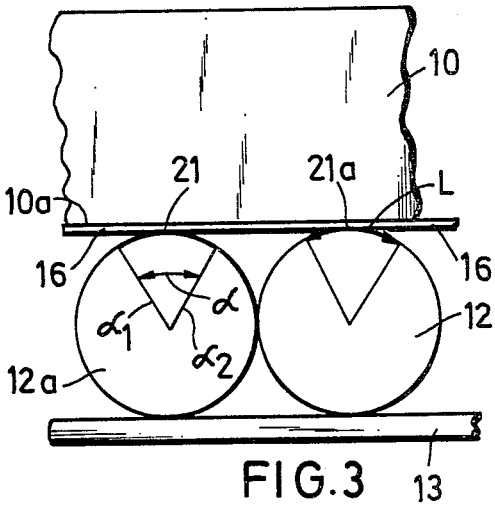
FIG. 3 is a view showing a portion of the inventive arrangement of FIG. 1, as seen in the direction identified by reference numeral III.

FIG. 2 shows a perforation cut 18 with small cuts 18*a*, 18*b* of shorter length, so that a relatively wide web 19 remains between the cuts 18*a* and 18*b*, arranged in a line. FIG. 2 also shows a further perforation with cuts 18*a* and 18*b* having a greater length, so that a web of smaller width remains therebetween. Finally, FIG. 2 shows a throughgoing cut 20 which is obtained in such a manner that the cuts 18*a*, 18*b* have a length sufficient for merging of the cuts into one another. These perforations or cuts are illustrated in FIG. 3.

For perforating or cutting, the foil 16 is arranged between the rollers 12 and the cutting edge 10*a* of the cutter 10. The cutter applies from above a pressure whose action is adjusted by the properties of the rubber band, as soon as further pressure-regulating measures, such as a supporting helical spring, are not provided. Thereby a cut of a point-like extension or a small length is obtained in apex points 21 and 21*a* at which the cutter contacts the roller tangentially and thereby in a point-like manner. Thus the cut is centered at the point of the tangential contact of the cutting edge with the rollers.

When a relative displacement between the cutter and rollers takes place in such a manner that the cutter 10 reciprocates in the predetermined double-arrow direction 22 shown in FIG. 2, or as will be described hereinbelow the rollers are displaced with the flexible strip 13, rubber band 14 and the support 15 in the longitudinal direction of the cutter 10, the rollers during the reciprocating displacement are turned by a certain angular distance $\alpha_1$ in a forward movement and $\alpha_2$ in a rearward movement.

During this movement the tangential contact of the cutting edge of the cutter with the individual rollers is maintained with the result that this point of the tangential contact travels over the arc length L. The arc length L on the outer periphery of the roller is determined by the angle $\alpha$, the value of the reciprocating stroke movement, and the diameter of the roller 12. By the selection of the diameter of the rollers and the stroke of the reciprocating movement, the length of a cut 18 can be adjusted so that, as can be seen from FIG. 2, a cut can be produced with a shorter or longer length, or merging into one another individual cuts forming a throughgoing cut 20. The arc length L is the cut length 18. The distance between the apex points 21,21*a* of the rollers corresponds to the distance between the neighboring cuts 18, as measured for center-to-center thereof. The rollers are composed of steel.

From the above presented grounds, it is possible in the event of foils which are difficult to cut for cutting with the abutting cutter, to provide a rotation from an initial position to the left and back to the initial position, and over this to the right and then again to the initial position back. During this movement the cutter is in action two times, so that the foil is cut to a half of its thickness during the movement in the first direction, and cut by the remaining thickness during the return movement.

In many cases, perforating or cutting of the foils in the event of the abutting cutter is performed by rolling of the rollers in only one direction of rotation, whereby prior to the return rotation of the rollers the cutter is lifted.

Figure 4:
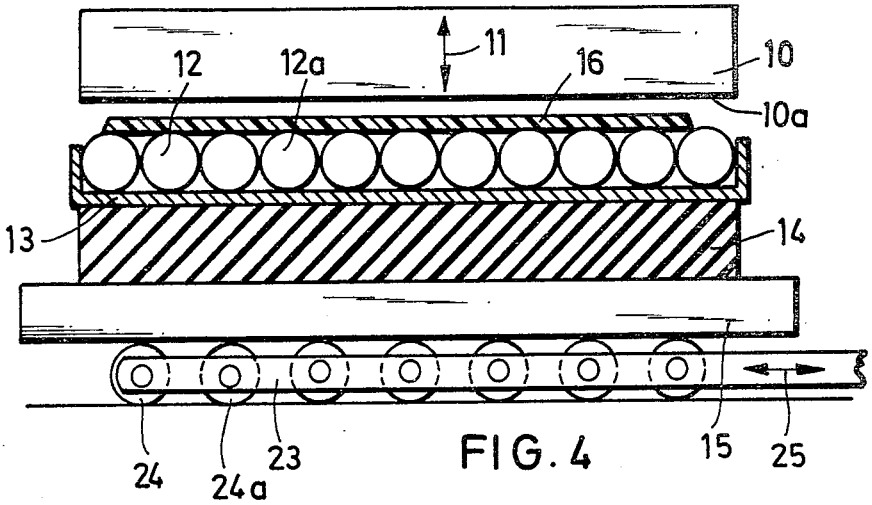
FIG. 4 is a view showing an arrangement for perforating or cutting foils in accordance with another embodiment of the present invention.

FIG. 4 shows that the cutter 10 is also movable in the predetermined double-arrow direction 11 towards the foil 16 and is lifted from the latter. In this construction, however, the cutter 10 is not displaceable in the plane of the rollers 16. The supporting band 15 rests on a carriage 23 which has a plurality of rollers 24 and 24*a* which are spaced from one another and supported so that they can rotate. Such carriages are available on the market as manufactured parts with different heights and lengths. The carriage is reciprocable in the direction of the double arrow 25.

Figure 5:
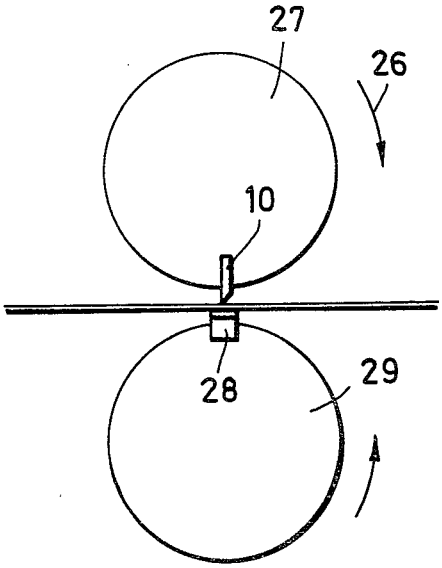
FIG. 5 is an end view of a rotary cutting device in accordance with the present invention.
Figure 7:
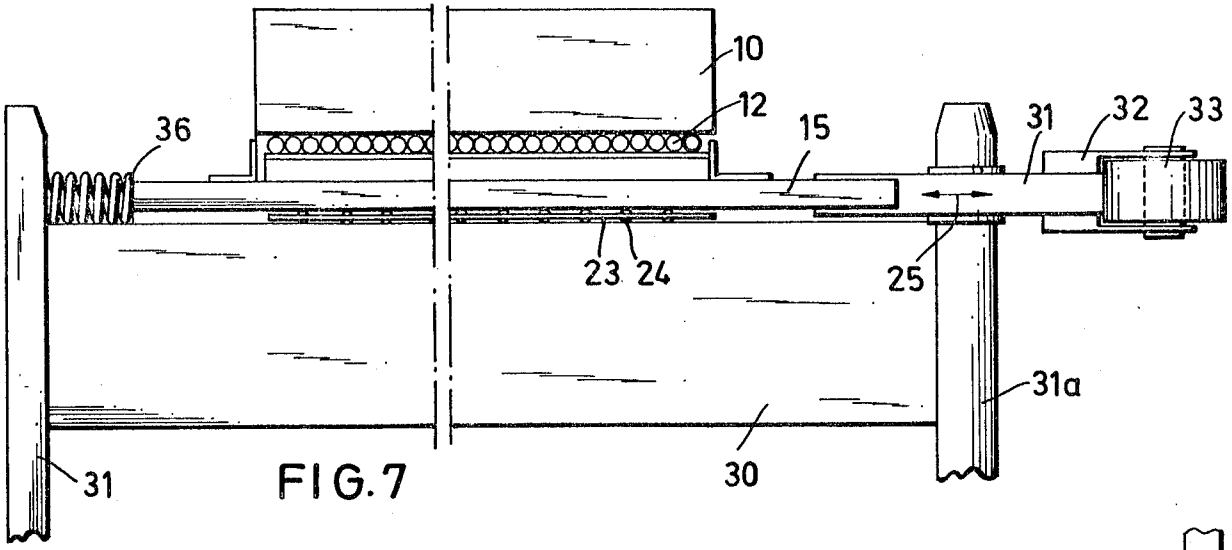
FIG. 7 is a view showing a perforating and cutting device in accordance with FIGS. 5 and 6 in a front view, as seen in the direction of the arrow VII.

FIG. 5 shows that the cutter 10 is arranged on a drum 27 which rotates in the direction of the arrow 26, whereas a countercutting support 28 is arranged on a drum 29 which rotates in synchronism with the drum 27. The perforating and cutting arrangement is especially advantageous with this rotary cutting device, which is shown in section in FIG. 6. It can be seen that the carriages 23, 24 roll on a carrier 30 which are mounted on both lateral walls 31 and 31*a* of the drum 29, as can be seen from FIG. 7.

Figure 8:
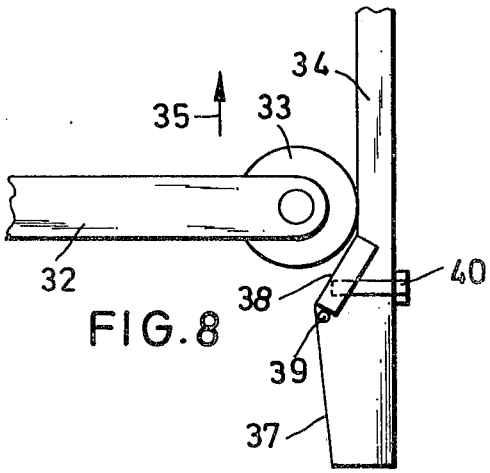
FIG. 8 is a view showing means for controlling the stroke in a plan view, from above.

The carriage 23, 24 is not reciprocatable directly, but a reciprocating stroke 25 is carried out by the support 15 which is extended by a respective displacing rod 31. The displacing rod 31 carries at its one end a roller 33 via a bracket 32. The roller 3 abuts against a stationary and round guiding rail, as can be seen in FIG. 8.

When the support 15 rotates in a predetermined direction of the arrow 35, the roller 33 reaches first an inclined surface 37 which has advantageously only a small inclination. Thereby the support 15 is displaced to the left and a spring 36 is compressed. The support can displace to the right under the action of the helical spring 36 over an inclined surface 38. This is the stroke during which the cutter abuts against the rollers 12 and provides the cut in one direction. As soon as the inclined surface 38 is displaced via a rotary axle 39, for example via an adjusting screw 40, thereby the cutting speed can be adjusted inasmuch as the force for cutting is applied by the spring 36. The stroke movement is controlled in such a manner that first the cutter is brought tangentially to the contact against the rollers 12, and the elastic band 14 is compressed by a small amount, for example 0.3 mm, and then the relative displacement between the cutter and the rollers 12 takes place so that the desired cut is produced. After this the cutter is lifted.

It should be mentioned that the length of the cut 18 can also be dimensioned in such a manner that, with a sufficiently dimensioned reciprocating stroke, and thereby a great arc length L, the cutter 10 can be lifted prematurely from the rollers, so that it does not abut against the whole available arc length L against the rollers.

The above presented description shows that the inventive perforating and cutting arrangement can be used in different ways and controlled with simple means, so as to obtain the desired different cut lengths and to change the cutting speed, if necessary.

It will be understood that each of the elements described above, or two or more together, may also find a useful application in other types of constructions differing from the types described above.

While the invention has been illustrated and described as embodied in an arrangement for perforating foils, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for perforating foils, particularly of synthetic plastic material, comprising an elongated cutter; and a counter element, said elongated cutter and said counter element being movable relative to one another in a direction of elongation of said cutter and also toward one another, said cutter being provided over its entire length with an uninterrupted cutting edge, and said counter element being composed of a plurality of rollers movable about their axes and located adjacent to one another, so as to provide for selective perforating or cutting.

2. An arrangement as defined in claim 1, wherein said rollers of said counter element are arranged at relatively small distances from one another, for example between 0.1 to 2 mm.

3. An arrangement as defined in claim 1, wherein said rollers are arranged so that they tightly abut against one another.

4. An arrangement as defined in claim 1, wherein said rollers of said counter element are arranged so that they are rotatable about their axis.

5. An arrangement as defined in claim 1, wherein said rollers are arranged so that they can roll.

6. An arrangement as defined in claim 1, wherein the upper apex of said rollers of said counter element are spaced from one another by a distance which corresponds to a distance between neighboring individual cuts of a perforation cut, as measured from center to center thereof.

7. An arrangement as defined in claim 1, wherein said rollers of said counter element have a diameter of between 3 and 5 mm and a length equal to a multiple of the diameter.

8. An arrangement as defined in claim 1, wherein said cutter is arranged reciprocable in a direction of its elongation.

9. An arrangement as defined in claim 1, wherein said cutter is immovable in a direction of its elongation, said rollers of said counter element being arranged so that they are movable in the direction of elongation of said cutter.

10. An arrangement as defined in claim 1, wherein said rollers are metallic; and further comprising a strip of metal on which said metallic rollers are supported, and an elastic band on which said metallic strip is supported.

11. An arrangement as defined in claim 10, wherein said strip which supports said metallic rollers is composed of steel.

12. An arrangement as defined in claim 10, wherein said elastic band which supports said metallic strip is composed of rubber.

13. An arrangement as defined in claim 10, and further comprising a carriage which support said elastic band and is reciprocable in a direction of elongation of said cutter.

14. An arrangement as defined in claim 13, wherein said carriage has a plurality of further rollers located at a distance from one another, and a frame pivotally arranging said rollers and reciprocable.

15. An arrangement as defined in claim 14, wherein said frame is arranged to carry said further rollers of said carriage.

16. An arrangement as defined in claim 14, wherein said frame is arranged to hold said further rollers of said carriage.

17. An arrangement as defined in claim 1, and further comprising a support which supports said counter element and is arranged reciprocable.

18. An arrangement as defined in claim 17, and further comprising a carriage having a plurality of further rollers, said support of said counter element being supported on said further rollers of said carriage.

19. An arrangement as defined in claim 17, and further comprising a helical spring, said support being reciprocable against a pressure of said helical spring.

20. An arrangement as defined in claim 19, wherein said spring is prestressed; and further comprising an inclined surface, said support being displaceable in one direction via said inclined surface and performing a stroke via said prestressed spring.

21. An arrangement as defined in claim 1; and further comprising a rotary drum and a counter drum, said cutter extending beyond a periphery of said rotary drum, and said rollers of said counter element being arranged at a periphery of said counter drum.

* * * * *